US005983766A

United States Patent [19]

Johnson

[11] Patent Number: 5,983,766

[45] Date of Patent: Nov. 16, 1999

[54] STEEL RULE CUTTING DIE WITH REMOVABLE CUTTING UNITS AND METHOD FOR USING SAME

[76] Inventor: Michael J. Johnson, 1669 Lou Graham, El Paso, Tex. 79936

[21] Appl. No.: 08/949,855

[22] Filed: Oct. 14, 1997

[51] Int. Cl.[6] ..... B26F 1/44

[52] U.S. Cl. ..... 83/698.61; 83/698.31; 83/696; 83/657

[58] Field of Search ..... 83/698.31, 698.61, 83/696, 697, 684, 657

[56] References Cited

U.S. PATENT DOCUMENTS

| | | | |
|---|---|---|---|
| 518,596 | 4/1894 | Gibbs | 83/696 X |
| 1,177,055 | 3/1916 | Zimmerman . | |
| 1,321,896 | 11/1919 | Davis . | |
| 1,646,413 | 10/1927 | Lossman . | |
| 1,737,500 | 11/1929 | Johnson . | |
| 2,097,693 | 11/1937 | Foster . | |
| 2,313,801 | 3/1943 | Carll . | |
| 2,395,083 | 2/1946 | Wilson . | |
| 2,550,299 | 4/1951 | Sabo | 83/657 X |
| 2,588,809 | 3/1952 | Demarest . | |
| 3,048,069 | 8/1962 | Berlin et al. . | |
| 3,049,039 | 8/1962 | Wright . | |
| 3,111,877 | 11/1963 | Rugenstein | 83/657 |
| 3,205,750 | 9/1965 | Strange . | |
| 3,263,547 | 8/1966 | Pfaff et al. | 83/657 |
| 3,335,628 | 8/1967 | Simms et al. . | |
| 3,340,758 | 9/1967 | Peterson et al. . | |
| 3,352,187 | 11/1967 | Knight | 83/657 |
| 3,373,643 | 3/1968 | Spengler . | |
| 3,411,208 | 11/1968 | Malm . | |
| 3,599,520 | 8/1971 | Wood . | |
| 3,626,799 | 12/1971 | Gerber et al. . | |
| 3,635,115 | 1/1972 | Rickenbacker | 83/696 |
| 3,752,042 | 8/1973 | Castille . | |
| 3,826,170 | 7/1974 | Jones et al. . | |
| 3,882,614 | 5/1975 | Albaladejo . | |
| 3,945,287 | 3/1976 | Dvorak . | |
| 3,982,458 | 9/1976 | Terasaka . | |
| 4,250,786 | 2/1981 | Bleich . | |
| 4,601,228 | 7/1986 | Steadman et al. . | |
| 4,754,677 | 7/1988 | McKindary . | |
| 4,829,854 | 5/1989 | Kammerling-Essmann . | |
| 4,884,484 | 12/1989 | Bakermans et al. . | |
| 4,921,154 | 5/1990 | Abe et al. . | |
| 4,981,061 | 1/1991 | Hillock et al. . | |
| 5,129,295 | 7/1992 | Geffros et al. . | |
| 5,275,076 | 1/1994 | Greenwalt | 83/698 |
| 5,402,698 | 4/1995 | Morrison . | |
| 5,515,749 | 5/1996 | Sandford . | |
| 5,520,080 | 5/1996 | Sandford . | |
| 5,676,032 | 10/1997 | Johnson . | |

FOREIGN PATENT DOCUMENTS

| | | |
|---|---|---|
| 4304030 | 8/1994 | Germany . |
| WO 8906184 | 7/1989 | WIPO . |

*Primary Examiner*—Rinaldi I. Rada
*Assistant Examiner*—T. Anthony Vaughn
*Attorney, Agent, or Firm*—Banner & Witcoff, Ltd.

[57] ABSTRACT

A steel rule die for cutting cloth and synthetic materials. The cutting die includes a primary substrate and a plurality of cutting units that are removably attachable to the substrate in such a manner that they are easy to adjust, remove and replace. The cutting units include secondary substrates with lengths of steel rule attached to them to form cutting cavities. Studs mounted to the primary substrate interface with tear-drop shared holes in the secondary substrates with to restrain them against motion perpendicular to the surface of the primary substrate while permitting movement of the cutting units in a horizontal plane with respect to the primary substrate. Adjustable securing rails positioned along the peripheries of the primary substrate are moved toward the fixed securing rails to restrain the secondary substrates against lateral and longitudinal motion. By moving the adjustable securing rails away from the fixed securing rails, the cutting units can be temporarily moved away from each other for cleaning scrap material therebetween. Foam can be disposed between the cutting units to minimize the possibility of scrap material becoming lodged between the cutting units, and aid in the removal of any scrap material that happens to become lodged between the cutting units.

32 Claims, 5 Drawing Sheets

STEEL RULE CUTTING DIE WITH REMOVABLE CUTTING UNITS AND METHOD FOR USING SAME

BACKGROUND OF THE INVENTION

This invention relates to steel rule die cutting and more particularly to an improved multi-cavity die with movable and adjustable cutting units.

Steel rule dies are commonly used for cutting cloth and cloth-like substances such as natural textiles and synthetic materials like vinyl. Steel rule dies are particularly advantageous in the repetitive cutting of a specific shape for use in clothing, furniture, shoes, and automotive trim panels. In brief, a steel rule cutting die typically comprises a base substrate or backing board in which grooves are cut and lengths of sharpened blade, known as steel rule, is formed to the same shape as the grooves and inserted in the grooves. The grooves are cut in the substrate in the pattern that is desired to be cut out of the material. Thus, when the steel rule is placed into the grooves, it forms cutting edges in the shape of the desired patterns. This die can be used together with a cutting press so that the die is pressed against a stack of material and the material is cut. Multiple layers of material can be cut with one pressing operation. Typically, one die will include several cavities, each with a different pattern and defined by a closed length of rule, so that several multiple patterns can be cut during a single pass through the press. Multiple cavities on a single die are nested together in an efficient configuration to minimize scrap material.

One problem with typical steel rule dies is the removal of scrap material from the regions between the cavities, i.e., between sections of adjacent rule, after each cutting process. Due to the bevel on the steel rule, scrap material that is situated between two cavities becomes compressed between the cavities and is difficult to remove. An operator must, therefore, perform a time-consuming cleaning of the die between each cutting process. Where the dies are closely spaced, the cleaning process is especially difficult. This results in extra cost and a decrease in the throughput of the cutting process. In order to alleviate the problem of cleaning scrap material, most dies have their cavities spaced apart from one another by at least ¼. This spacing of ¼ inch can cause significant cost in terms of scrap material.

Another problem is that, once the groove is cut into the substrate and the steel rule is placed into the groove, the cavities are permanently arranged in the die. If the pattern of one cavity needs to be modified in any respect, it is necessary to construct a completely new die at significant expense. In other words, there is no flexibility to change the patterns being without performing the costly and time consuming procedure of making a whole new die.

SUMMARY OF THE INVENTION

The present invention solves these problems by making the cavities part of a cutting unit that is separate from the substrate and removably attaching the cutting units to the substrate in such a manner that they are easy to adjust, remove and replace. Because the cutting units are adjustable relative to the substrate, they can be temporarily separated from each other for cleaning of scrap material from between the steel rule of adjacent cavities. Because the scrap material can be easily cleaned, the steel rule of adjacent cutting units can also be spaced closer to each other than ¼ inch.

Also, because the cutting units are removable, they can be replaced with cutting units that have a different pattern. Therefore, the material cutting process is more flexible and allows design changes in the material pattern to occur during the middle of a production run.

The die of the present invention consists of a primary substrate with studs protruding from one side thereof and with securing rails on its peripheries. The die also has cutting units including secondary substrates with lengths of steel rule attached to them to form cutting cavities. The secondary substrates are removably coupled to the primary substrate to form a multi-cavity die.

The studs on the surface of the primary substrate mate with the secondary substrates and restrain them against motion perpendicular to the surface of the primary substrate. A pair of securing rails positioned along the peripheries of the primary substrate are movable and have tightening mechanisms that allow them to engage and sandwich the secondary substrates. This restrains the secondary substrates against lateral and longitudinal motion, e.g., horizontal motion, relative to the primary substrate.

By loosening the securing rails a small distance, the secondary substrates become unrestrained in their lateral and longitudinal directions and can be moved apart from each other by a small amount. This allows scrap material to be cleaned from between the cutting units after a cutting process is performed. By loosening the securing rails a larger amount, the cutting units can be removed entirely from the studs on the primary substrate. This allows a cutting units to be replaced with a cutting unit having a cutting pattern different from that of the removed cutting unit. Also, if the steel rule on a cutting unit becomes damaged, that cutting unit can be removed to facilitate the repairing or replacement of the damaged rule, or that cutting unit can be replaced by another cutting unit having undamaged rule.

The cutting units are restrained against horizontal movement, e.g., laterally and longitudinally, by being clamped between securing rails. Each cutting unit contacts, and is sandwiched by, either a securing rail or another cutting unit on each side. If a secondary substrate is irregularly shaped, clamping blocks can be added between the cutting units to allow them to better contact each other and to assist in the clamping and securing in the horizontal directions.

The steel rule for each cutting unit is preferably mounted around the periphery of the secondary substrate of that cutting unit. Therefore, when adjacent cutting units are in contact with each other, the steel rule of adjacent cutting units are also in contact with each other. Side bevel rule is preferably used to minimize the possibility of material becoming wedged between the rule of adjacent cutting units resulting in an incomplete cutting operation.

It is an objective of the present invention to provide a multi-cavity die wherein the cavities can be moved relative to each other to allow cleaning of scrap material between cutting operations.

It is a further objective of the present invention to provide a multi-cavity die wherein the cavities can be removed and replaced with cavities of different shapes.

It is a further objective of the present invention to provide a multi-cavity die wherein the cavities can be quickly and easily loosened or removed from their primary substrate.

It is a further objective of the present invention to provide a multi-cavity die that uses side-bevel rule to form cavities wherein adjacent cavities are in contact with each other and can be loosened relative to each other to allow cleaning of scrap material between cutting operations.

It is yet another objective of the present invention to provide a method of using a die having a primary substrate and first and second cutting units adjustably mounted on one side of the primary substrate. The method includes providing foam between the first and second cutting units. The foam is laterally compressing by moving the first and second cutting units towards each other. Pieces are cut from a sheet of material with the first and second cutting units simultaneously. The foam between the first and second cutting units is laterally expanded. This minimizes the possibility of scrap material becoming lodged between the cutting units, and aids in the removal of any scrap material that happens to become lodged between the cutting units.

The foregoing and other objects and advantages of the invention will be more filly understood from the following detailed description of the invention and from the accompanying drawings.

DETAILED DESCRIPTION OF THE INVENTION

Figure 1:
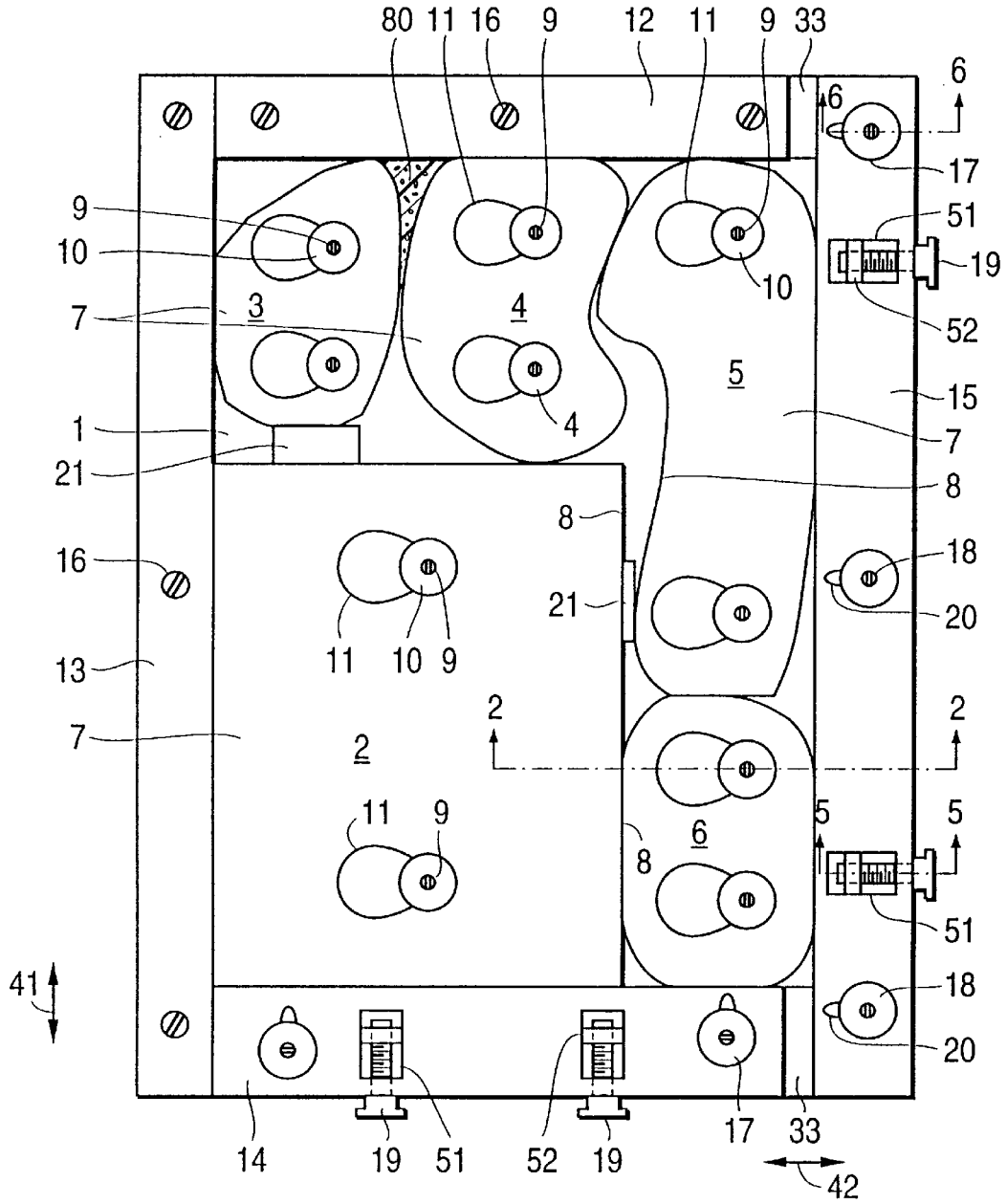
FIG. 1 is a plan view of a die with removable cavities according to the present invention.

As shown in FIG. 1, the die of the present invention has a primary substrate 1 and a plurality of cutting units 2–6 attached thereto. The primary substrate 1 is preferably a board made from plywood or any other suitable material and lies in a plane. For reference purposes, the plane is defined as being horizontal. Each cutting unit 2–6 consists of a secondary substrate 7 with lengths of steel rule 8 attached thereto to form cutting patterns. The secondary substrates 7 can be constructed as a solid board made from plywood or other suitable material. Alternatively, the secondary substrates 7 can be constructed as a frame structure with open center sections to reduce weight. The steel rule 8 has a first end 30 which is attached to the secondary substrates 7 and an opposite end with a sharpened edge 31 protruding away from the secondary substrates 7 for cutting patterns in a shape corresponding to the shape of the rule 8. The steel rule 8 is preferably attached to the periphery of the secondary substrates 7 to form the periphery of the cutting units 2–6. The raised cutting edges 31 of each cutting unit 2–6 form a recessed section or cavity 32 in which the stamped material enters after it is cut from its sheet.

Figure 2:
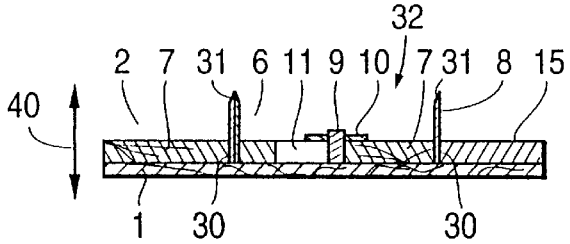
FIG. 2 is a sectional view taken along line 2—2 of FIG. 1.

Each cutting unit 2–6 and its respective cavity 32 has an inside which is located within its respective length of rule 8 and an outside located beyond its respective length of rule 8. As shown in FIG. 2, the length of rule 8 has an inner side disposed adjacent the inside of the cavity 32, and an outer side disposed adjacent the outside of the cavity 32. The rule 8 also inherently includes a geometric center substantially bisecting the length of rule 8. As is further shown in FIG. 2, the cutting edge 31 of the length of rule 8 is disposed outwardly from the geometric center of the length of rule 8 with respect to its respective cavity 32.

The cutting units 2–6 are held to the primary substrate 1 via holding devices, preferably at least two holding devices per cutting unit 2–6. In a preferred embodiment, each holding device includes a shaft or stud 9 attached at one end to the primary substrate 1, with a washer 10 fixed thereto adjacent the end of the stud 9 distal from the primary substrate 1 to form an enlarged head section. The secondary substrates 7 have teardrop shaped holes 11 therein. The holes 11 are sized and shaped so that the wide end of the hole 11 is larger than the diameter of the washer 10. This permits the washers 10 to extend through holes 11 in secondary substrate 7. Secondary substrates 7 can be horizontally translated, e.g., slid, a small amount such that washer 10 of stud 9 is situated toward the narrow end of hole 11. In this position, the washers 10 retain the secondary substrate 7 against motion perpendicular to the plane of the primary substrate 1, i.e., it retains the secondary substrate 7 against vertical movement along axis 40. However, washers 10 permit secondary substrates 7 to move in a horizontal plane with respect to primary substrate 1.

Figure 8:
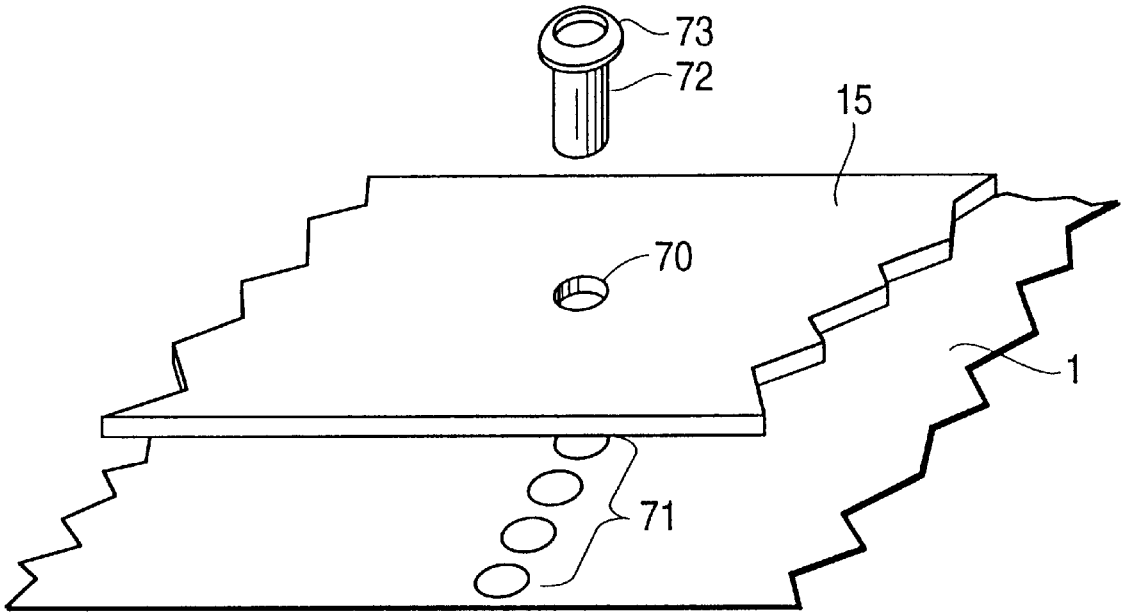
FIG. 8 is an exploded perspective view of another alternative arrangement for adjustably attaching the securing bars to the primary substrate.

Side securing rails 12–15 are used to prevent cutting units 2–6 from horizontally moving any significant amount on the primary substrate 1 when the securing rails 12–15 are placed in a securing position. In the embodiment shown in FIG. 1, securing rails 12–15 accomplish this by applying horizontal forces to the peripheries of the cutting units 2–6, i.e., they clamp the cutting units 2–6 therebetween. However, as shown in FIG. 8 and discussed below, one or more securing rails 12–15 can be locked in a position which prevent cutting units 2–6 from moving any significant amount in the horizontal plane but permit infinitesimal and insignificant movement of the cutting units 2–6.

The set of securing rails 12–15 include two fixed securing rails 12 and 13 and two movable or adjustable securing rails 14 and 15. For reference purposes, the rails 12–15 are referred to by their relative positions as shown in FIG. 1. The top securing rail 12 and the left-side securing rail 13 are the fixed securing rails, being affixed to the primary substrate 1 via screws 16 or other suitable mounting devices. The bottom securing rail 15 and the right-side securing rail 15 are slidably mounted to primary substrate 1. Bottom securing rail 15 is slidable horizontally with respect to primary substrate 1 along a longitudinal axis 41. Right-side securing rail 14 is slidable horizontally with respect to primary substrate 1 along a lateral axis 42 perpendicular to longitudinal axis 41.

Figure 6:
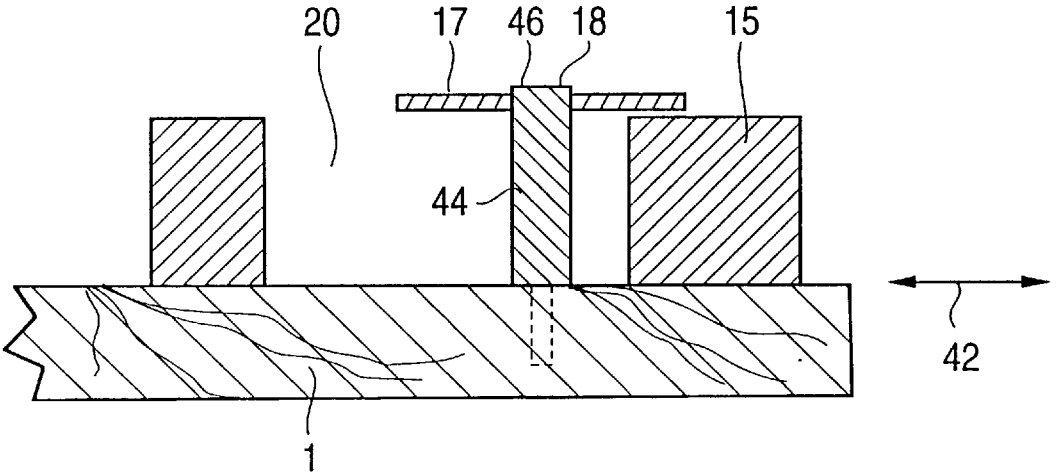
FIG. 6 is a cross-section taken along line 6—6 of FIG. 1.

The adjustable securing rails 14 and 15 are connected to the primary substrate 1 via devices that tighten, and align, and secure the adjustable rails 14 and 15 to the primary substrate 1. As shown in FIGS. 1 and 6, the aligning devices consist of pins 18 retaining the securing rails 14 and 15 in a vertical direction and permitting adjustment between the primary substrate 1 and a securing rail 14 or 15 along an axis 41 or 42 in the horizontal plane. Each pin 18 includes a shaft 44 and an enlarged head portion or washer 17 attached adjacent the end of the shaft 46 distal from primary substrate 1. The shaft 44 of each pin 18 extends through a respective slotted hole 20 in a respective adjustable securing rail 14 or 15 and is threadably attached to the primary substrate 1. Its enlarged head portion 17 is larger than the width of slot 20 and prevents its respective securing rail 14 or 15 from moving in a vertical direction, i.e., along axis 40.

Figure 5:
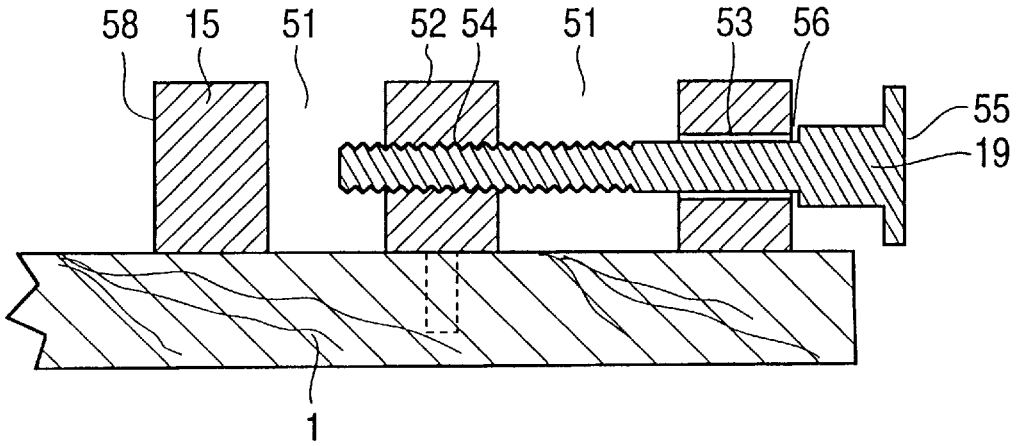
FIG. 5 is a cross-section taken along line 5—5 of FIG. 1.

As shown in FIGS. 1 and 5, each securing rails 14 and 15 is adjusted by a threaded fastener system which permits the adjustment of the securing rails 14 and 15 and maintains their relative position once adjusted. In a preferred embodiment, the securing rails 14 and 15 have slots 51 cut therein. A coupling element 52 is attached to the primary substrate 1 and includes a hole 54 which is threaded to permit rotation for axial displacement in the direction that its respective rail 14 or 15 will be moving in. Coupling element 52 extends upwardly through the slot 51 in the securing rail. A threaded tightener 19 extends through a clearance hole 53 in the securing rail 14 or 15, and threadably engages hole 54 in coupling element 52. One end of the tightener 19 preferably includes a gripping knob 55, and a shoulder 56 is positioned between the knob 55 and the threads.

When the threaded tighteners 19 are rotated, the rails 14 and 15 move horizontally, i.e., either laterally or longitudinally, relative to the pins coupling element 52 and to the primary substrate 1. For example, as shown in FIG. 5, if knob 55 is rotated clockwise, the tightener 19 will move to the left with respect to coupling element 52 as the threads of tightener 19 rotate through coupling element 52. As this occurs, shoulder 56 of the tightener 19 presses against the outer edge of securing rail 15 to physically push the rail 15 to the left with it. This, in turn, pushes the inner edge 58 of securing rail 15 against the cutting units 2–6 to effectively clamp the cutting units between the securing rails in a horizontal direction. To loosen the securing rails 14 and 15, the threaded tightener 19 is rotated in an opposite direction so it will back out of the threaded hole 54 in coupling element 52. Securing bar 15 is then free to move back up to the shoulder 56.

It is noted that two spaced devices are used for alignment/guidance and tightening/securing. More particularly, the pin 18 and slot 20 arrangement is used for alignment and guidance, while tightener 19 and coupling element 52 is used for tightening, securing, and adjusting. It is recognized that these two arrangements could be combined in a single arrangement. For example, the lateral edges of coupling element 52 and slot 51 could be appropriately toleranced to perform the guiding and aligning functions necessary. However, an additional element, e.g., a removable enlarged head section, would preferably be removably attached to the upper side of coupling unit 52 to prevent the movement of the securing rails 14 and 15 in a vertical axis 40.

The left edge of bottom adjustable securing rail 14 may be designed to butt against the edge of fixed left-side securing rail 13. This can be used to aid in the alignment of adjustable securing bar 14. A gap 33 may be provided between right-side adjustable securing rail 15 and top and bottom securing rails 12 and 14 such that right-side adjustable securing rail 15 is freely movable within its desired range without any interference from the top and bottom securing rails 12 and 14.

When the securing rails 14, 15 are tightened they horizontally clamp the cutting units 2–6 and prevent them from moving horizontally relative to the primary substrate 1. For instance, when securing rail 15 is tightened it contacts cutting unit 5. Cutting unit 5 in turn contacts cutting unit 4. Cutting unit 4 contacts cutting unit 3 which contacts stationary left-side securing rail 12. Accordingly, when securing rail 15 is tightened, cutting units 3, 4, and 5 are sandwiched in place and retained against lateral movement along axis 42 relative to the primary substrate 1. Securing rails 13 and 15 similarly contact and sandwich cutting units 6 and 2 to retain them against lateral movement along axis 42.

The bottom securing rail 14 contacts cutting units 2 and 6, which in turn contact cutting units 3, 4, and 5, which in turn contact stationary top securing rail 12. When securing rail 14 is tightened the cutting units 2–6 are sandwiched and retained against longitudinal horizontal movement along axis 41 because they are clamped between securing rails 12 and 14.

When the securing rails 14, 15 are loosened, the cutting units 2–6 are free to move horizontally, and can be separated from each other to allow cleaning of scrap material from between them. The securing rails 14, 15 are preferably toleracenced such that the cutting units 2–6 can be horizontally translated so that the wide part of holes 11 are aligned with washers 10, and the cutting units 2–6 can be removed from primary substrate 1. This facilitates replacement and repair of the cutting units 2–6.

In many cases the cutting units 2–6 may be irregularly shaped. For example, as shown in FIG. 1, there may be a gap between cutting units 2 and 3 or between cutting units 2 and 5. To prevent these cutting units from not being substantially fully constrained against horizontal movement, appropriately-sized spacer blocks 21 are inserted between cavities wherever needed. FIG. 1 shows spacer blocks 21 between cutting units 2 and 3 and between cutting units 2 and 5. Spacer blocks 21 are preferably attached to the outside of one of the adjacent cutting units it is positioned between. Spacer blocks 21 can be made from a foam or other resilient material or alternatively can be made from a rigid material, e.g., wood. Use of a resilient material is advantageous as it need not be made to tight tolerances.

FIG. 2 shows a cross-section of a portion of the die as taken along line 2—2 of FIG. 1. Stud 9 can be seen to be screwed into the plywood of the primary substrate 1 with washer 10 attached to the stud 9. The washer 10 retains the secondary substrate 7 of cutting unit 6 from movement perpendicular to the plane of primary substrate 1. Steel rule 8 is attached to the edges of the secondary substrates 7 of cutting units 2–6 with the sharpened edge 31 of steel rule 8. In a preferred embodiment, the steel rule 8 is of the side bevel type, with its sharpened edge 31 disposed on the outer side of the rule 8 relative to the rule's respective cavity 32. When two sections of side bevel rule 8 are adjacent to each other, the side edges adjacent the sharpened edges 31 of the two sections of rule 8 are in contact with each other. Securing rail 15 is shown in FIG. 2 as being tightened against the side of cutting unit 6 to restrain the cutting units 2–6 against lateral horizontal movement. When securing rail 15 is loosened, the secondary substrate 7 of cutting unit 6 can slide toward the securing rail 15 so that there is a gap between cutting unit 6 and cutting unit 2 to allow scrap material to be cleaned therebetween.

Figure 3:
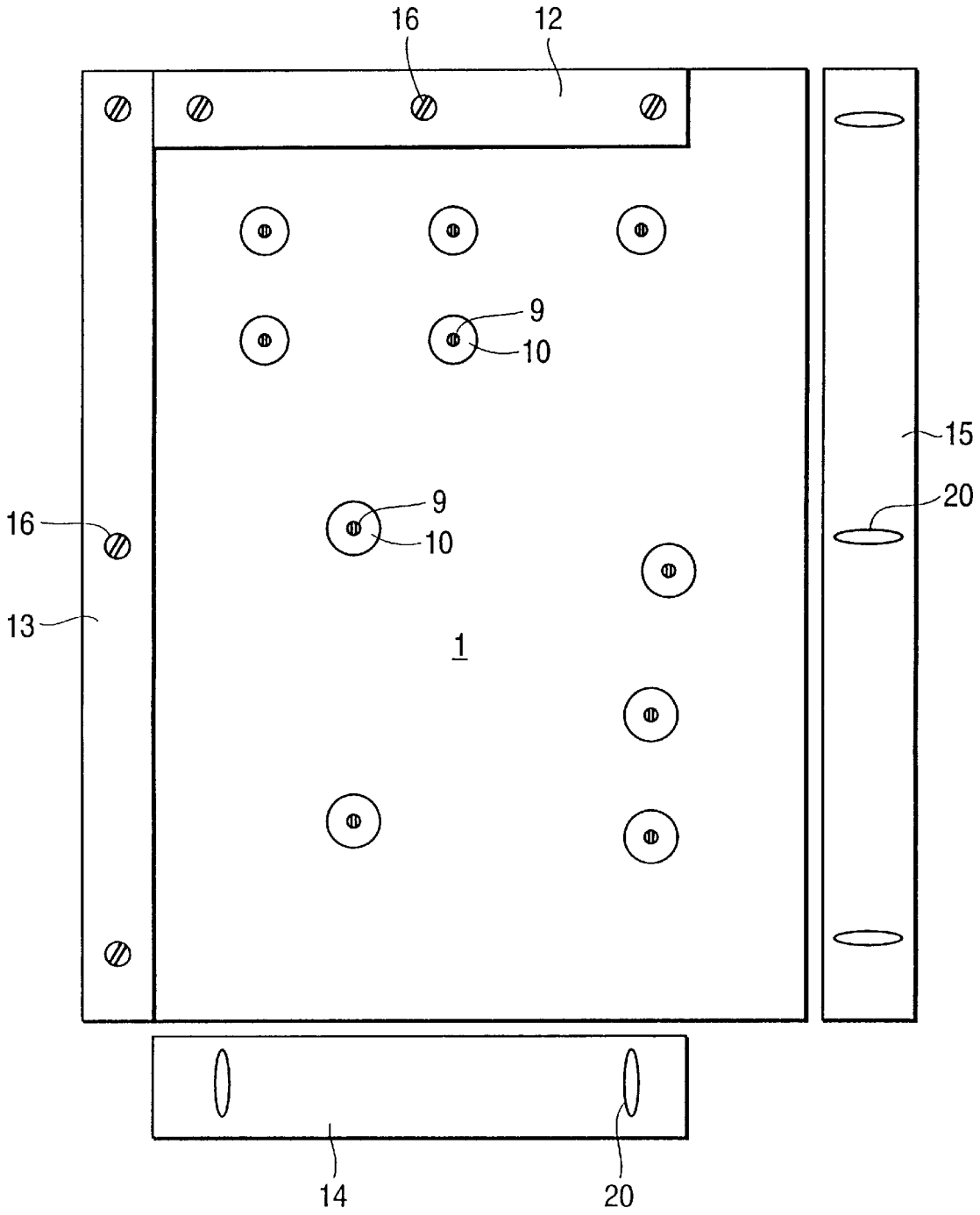
FIG. 3 is a plan view of the primary substrate according to the present invention with the cavities and two of the securing rails removed.

FIG. 3 shows primary substrate 1 with the cutting units 2–6 removed. It can be seen that the studs 9 with washers 10 are spaced appropriately to accept the cutting units 2–6 at their desired locations. The studs 9 are removably mounted to the primary substrate 1 so that they can be moved to change the configuration of the cutting units 2–6 on the primary substrate 1. That is, the studs 9 can be unscrewed from the primary substrate 1 and threaded in the primary substrate 1 at alternative locations. The top fixed securing rail 12 and the left-side securing rail 13 are threadably affixed to the primary substrate 1 via mounting screws 16. The bottom securing rail 14 and the right-side securing rail 15 are shown in FIG. 3 as being removed from the primary substrate 1. The bottom and right-side rails 14 and 15 are movably attached to the primary substrate 1, for instance through a threaded type fastener that extends through slots 20 on rails 14 and 15 to allow the securing rails 14 and 15 to be horizontally adjusted on the primary substrate 1. As previously described, alternative methods of adjustably coupling the securing rails 14 and 15 to the primary substrate 1 can be employed however it is preferable that the method employed permit the rails 14 and 15 to be tightened or loosened quickly and easily.

Figure 4:
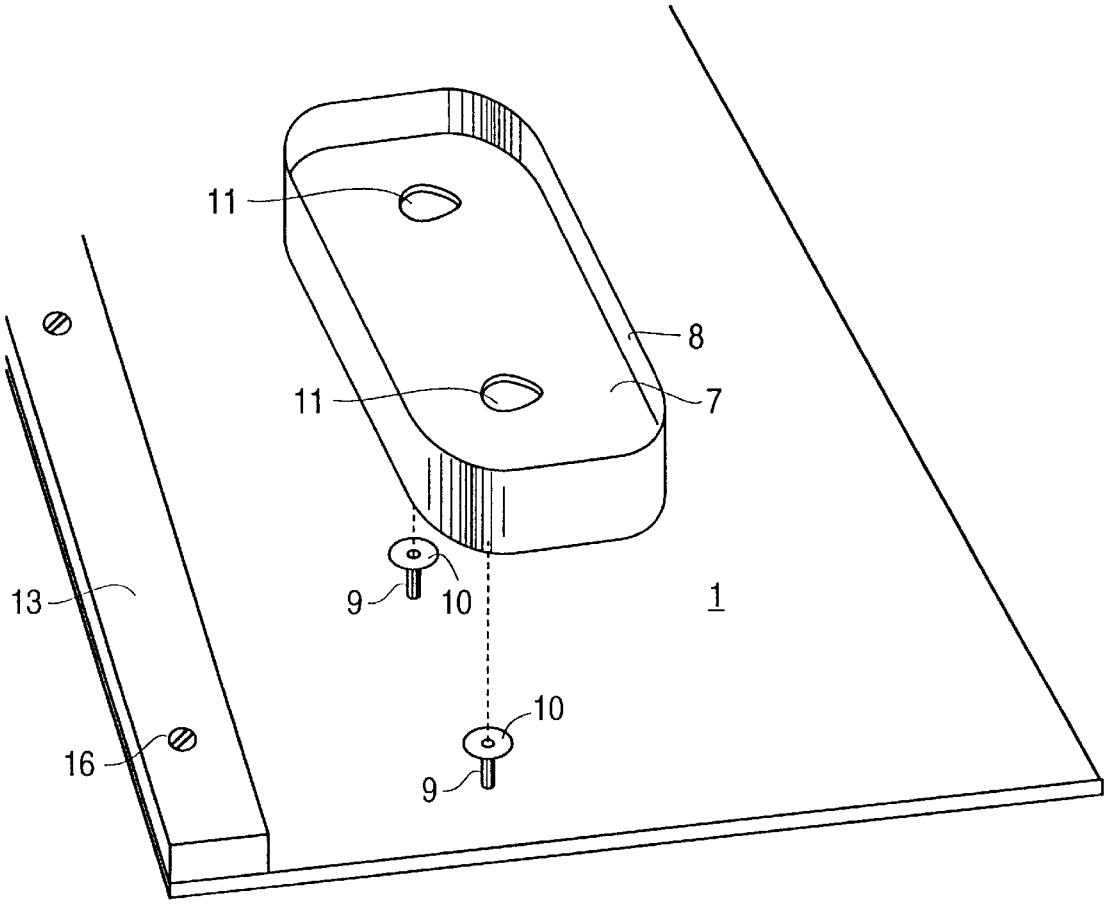
FIG. 4 is a perspective view of the die according to the present invention showing a cavity being installed on the primary substrate.

FIG. 4 shows a cutting unit in the process of being installed on two studs 9 on the primary substrate 1. During installation, the wide portion of holes 11 in the secondary substrate 7 of cutting unit are dropped over the washers 10 of studs 9. The cutting unit can then be horizontally translated, e.g., slid, to the left so that the studs 9 are located in the narrow portion of holes 11. The washers 10 retain the secondary substrate 7 on the primary substrate 1 and prevent vertical movement therebetween.

To assemble the die of the present invention, the bottom and right-side adjustable securing rails 14 and 15 are either loosened or completely removed from the primary substrate 1 as shown in FIG. 3. With the adjustable securing rails loosened or removed, the cutting units 2–6 are mounted on the primary substrate 1 by placing the wide portion of holes 11 in the secondary substrates 7 over the washers 10 of studs 9 and slightly horizontally translated as previously described. At this point the cutting units 2–6 will all be loosely mounted onto the primary substrate 1. The cutting units 2–6 are then pushed together so that they contact each other as shown in FIG. 1. If necessary, spacer blocks 21 are also inserted between the cutting units 2–6 during this assembly step. After the cutting units 2–6 are in place and are contacting each other, the bottom securing rail 14 and the right-side securing rail 15 are tightened so as to firmly hold all of the cutting units 2–6 in place on the primary substrate 1. The die is now ready to use for a cutting operation in the same manner that a standard multi-cavity steel rule die would be used.

Between cutting operations, some scrap material will become wedged between the cutting units 2–6 of the die. Removal of this scrap material is facilitated by loosening the cutting units 2–6 to free any wedged scrap material therebetween. The cutting units 2–6 can be loosened by loosening the bottom securing rail 14 and the right-side securing rail 15. It is not necessary to completely loosen the adjustable securing rails 14, 15. They only need to be loosened by an amount sufficient to allow the cutting units 2–6 to be separated from each other by a small amount. When the cutting units 2–6 have been separated from each other by a small amount, it is easy to remove any scrap material. The adjustable securing rails 14 and 15 are then tightened again after removal of the scrap material and the die is ready to use in the next cutting process.

If one of the cutting units 2–6 needs to be changed, in order to change the shape of the pattern being cut, or to repair a damaged section of steel rule, the securing rails 14 and 15 are completely loosened or removed and then the cutting unit to be removed can be lifted off of the studs 9 on the primary substrate 1. When installing a new cutting unit 2–6, it may have a different shape that would require the studs 9 to be in different locations on the primary substrate 1. If that is the case, then the studs may need to be removed from the primary substrate 1 and re-installed in their proper location. A change in the patterns of the cutting units 2–6 may also necessitate extra spacer blocks 21.

Figure 7:
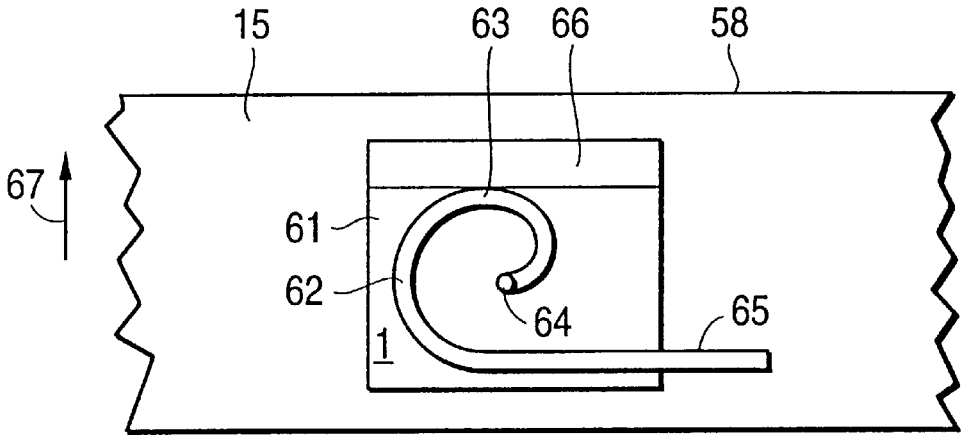
FIG. 7 is top plan view of an alternative arrangement for adjustably attaching the securing bars to the primary substrate.

In an alternative embodiment as shown in FIG. 7, each securing rails 14 and 15 is adjusted by a clamping bar system which permits the adjustment of the securing rails 14 and 15 and maintains their relative position once adjusted. In this embodiment, the securing rails 14 and 15 have slots 61 cut therein. An upstanding support, schematically shown by reference numeral 64, is attached to the primary substrate 1. A clamping bar 62 rotatable with respect to the support has a portion 63 adjacent the support which includes a gradually increasing radius, and an opposing end 65 which serves as a handle. The securing rails 14 and 15 preferably include an upwardly projecting block 66 which serves as an abutment surface for clamping bar 62. The clamping bar 62 can be fixed and/or locked with respect to support 64 and securing rail 15 by any suitable arrangement.

When the clamping bar 62 is rotated, its respective rail 15 moves horizontally relative to the upstanding support 64 and to the primary substrate 1. For example, as shown in FIG. 7, if clamping bar 62 is rotated clockwise, its portion with the gradually increasing radius 63 pushes against block 66 causing the rail to move in the direction of arrow 67, and pushes the inner edge 58 of securing rail 15 against the cutting units 2–6 to effectively clamp the cutting units between the securing rails in a horizontal direction. The clamping bar 62 may be locked by any suitable arrangement to lock the bar 14 and 15 in place. To loosen the securing rails 14 and 15, the clamping bar 62 is rotated in an opposite direction.

Another embodiment to adjust the securing rails 14 and 15 and maintain their relative position once adjusted is shown in FIG. 8. In this embodiment, the securing rails 14 and 15 have a hole 70 cut therein. The primary substrate 1 has a series of holes 71 located therein. Each of the series is longitudinally spaced from an adjacent hole in the direction in that the respective securing rail 15 is horizontally adjustable with respect to the primary substrate 1. The securing rail 15 is pushed towards the cutting units 2–6 to press them together into the desired configuration. Once the securing rail 15 has reached a position where the cutting units 2–6 cannot be moved closer together, a retaining pin 72 having an enlarged head 73 is inserted through hole 70 in retaining bar 15 and its closest positioned hole 71 in the primary substrate 1. It is possible that retaining bar 15 might need to be moved a small amount away from the cutting units 2–6 to fit into the next adjacent hole 71. This small amount of movement should effectively prevent the cutting units 2–6 from moving in the horizontal plane, though it may permit some insignificant horizontal movement—which could be eliminated by using foam 80 as discussed below. The retaining pin 72 may be locked into position by any desired arrangement, e.g., its end opposite the enlarged head may include threads upon which a nut may be attached thereto on the opposite side of primary substrate. The arrangements of FIGS. 7 and 8, would preferably also use a pin and slot arrangement as previously described to permit aligned movement along a desired axis.

Alternatively, the tightening devices may take other forms such as clips, pins, toggle clamps, or spring loaded or other clamping devices. The important feature of the tightening devices is their capability to tighten or loosen the securing rails 14 and 15 quickly and easily.

Foam 80, as shown in one location in FIG. 1, may be positioned between all or some of the adjacent cutting units 2–6 to aid in the ejection of the cut scrap material. If desired, the foam 80 may be mounted on the outer peripheries of selected rule sections of the cutting units 2–6. When the adjustable securing rails 14 and 15 are moved towards the cutting units 2–6, the foam 80 between the cutting units 2–6 is compressed. Upon the adjustable securing rails 14 and 15 becoming fixed, the foam remains compressed in between the cutting units 2–6 and will aid to eject scrap material from those regions. In the event that scrap material becomes lodged between the cutting units 2–6, the adjustable securing bars 14 and 15 need only be loosened a small amount. The foam 80, being compressed, will expand pushing the cutting units 2–6 away from each other to fill the rectangular region between the securing rails 12–15. As the spaces in between the cutting units 2–6 will increase slightly, any lodged scrap material will tend to dislodge itself automatically.

In lieu of attaching the foam 80 to the peripheries of cutting units 2–6, the cutting units 2–6 can be placed in a loose or expanded position, i.e., where they are not tightened within rails 12–15, and a sheet of foam can be placed on top of the cutting units 2–6 and between the rails 12–15. The die with the foam on top could be run into a press which, in combination with the rule, cuts the foam 80 into pieces that fit within each cavity and between each cutting unit 2–6. Upon tightening the adjustable rails 14 and 15, the cutting units 2–6 are moved towards each other to compress the foam 80 between the cutting units 2–6. The adjustable rails 14 and 15 may subsequently be loosened and tightened between cuts whenever necessary, to minimize the possibility of scrap material becoming lodged between the cutting units, and aid in the removal of any scrap material that happens to become lodged between the cutting units. If desired, an adhesive may be applied to the secondary substrates 7 to affix the foam 80 within the cutting units 2–6. The foam 80 within the cutting units 2–6 will also help eject the desired cut patterns of material.

While preferred embodiments of the invention have been shown and described, it will be apparent to those skilled in the art that various modifications may be made in these embodiments without departing from the scope of the invention. For instance, the specific type of tightening mechanism for securing rails 14, 15 may be modified or the shape of the holes 11 in the secondary substrates 7 could be varied. Further, springs or other compressible members could be used in addition to or in lieu of foam 80 to move the cutting elements 2–6 away from each other when the adjustable rails 14 and 15 are loosened. Therefore, it is intended that the invention not be limited to the particular embodiments disclosed but that the scope of the invention be defined by the following claims.

What is claimed is:

1. A cutting die comprising:

a primary substrate, said primary substrate defining a substantially horizontal plane;

a plurality of cutting units; each said cutting unit mounted to said primary substrate and including a length of rule defining a cavity by forming the periphery thereof, a horizontal element extending across the cavity, said length of rule mounted to the horizontal element, said length of rule including a cutting edge distally disposed from its respective horizontal element, wherein said plurality of cutting units include first and second cutting units, and said respective lengths of rule from the first and second cutting units are in contact with each other.

2. The cutting die as claimed in claim 1, wherein for each cutting unit, said cavity having an inside within its length of rule and an outside beyond its length of rule, said length of rule having an inner side disposed adjacent the inside of said cavity, an outer side disposed adjacent the outside of said cavity, and a geometric center substantially bisecting the length of rule, wherein said cutting edge is disposed outwardly from the geometric center of said length of rule with respect to said cavity.

3. The cutting die as claimed in claim 1, wherein said vertical cutting unit retaining elements are attached to said primary substrate.

4. The cutting die as claimed in claim 3, wherein said vertical cutting unit retaining elements include a shaft member extending generally perpendicular to said plane and an enlarged end section distal from said primary substrate, each said horizontal element having a hole therein corresponding to a respective retaining element, each said hole having a first portion larger than said enlarged end section and a second portion smaller than said enlarged end section.

5. The cutting die as claimed in claim 3, wherein horizontal cutting unit retaining elements include first, second, third, and fourth retaining bars, said first and second retaining bars fixedly mounted to said primary substrate and third and fourth retaining bars adjustably mounted to said primary substrate; wherein said third retaining bar is adjustably mounted for movement along a first axis and said fourth retaining bar is adjustably mounted for movement along a second axis, perpendicular to said first axis, said first and second axes being in a horizontal plane.

6. The cutting die as claimed in claim 1, wherein horizontal cutting unit retaining elements include first, second, third, and fourth retaining bars, said first and second retaining bars fixedly mounted to said primary substrate and third and fourth retaining bars adjustably mounted to said primary substrate; wherein said third retaining bar is adjustably mounted for movement along a first axis to horizontally restrain the cutting units between the first and third retaining bars, and said fourth retaining bar is adjustably mounted for movement along a second axis, perpendicular to said first axis, to horizontally restrain the cutting units between the second and fourth retaining bars.

7. The cutting die as claimed in claim 6, further comprising spacer elements disposed between and contacting the length of rule from a pair of adjacent cutting units.

8. The cutting die as claimed in claim 6, further comprising rotatable tightening elements for adjusting the horizontal position of the third and fourth retaining bars with respect to said primary substrate.

9. The cutting die of claim 1, further comprising at least one compressible member disposed between adjacent cutting units.

10. A cutting die comprising:

a primary substrate comprising a rectangular platen with an upper surface and first, second, third, and fourth peripheral sides;

a plurality of studs protruding from the upper surface of said primary substrate;

securing rails, each mounted to said primary substrate adjacent said first, second, third, and fourth peripheral sides, respectively;

a plurality of cutting units each comprising a secondary substrate and a length of steel rule to form a cutting pattern;

said plurality of studs on said primary substrate cooperating with the secondary substrates of said plurality of cutting units to restrain said cutting units from moving perpendicular to the upper surface of said primary substrate; and said securing rails cooperating with said plurality of cutting units to restrain the cutting units against lateral movement relative to said primary substrate.

11. The cutting die of claim 10, further comprising at least one compressible member disposed between the steel rule of adjacent cutting units.

12. The cutting die of claim 11, wherein at least one cutting unit further includes foam disposed on its respective secondary substrate and within its respective length of rule.

13. The cutting die as claimed in claim 1, wherein the horizontal cutting unit retaining elements include first and second retaining bars, said first retaining bar fixedly mounted to said primary substrate and said second retaining bar adjustably mounted to said primary substrate; wherein said second retaining bar is adjustably mounted for movement along a first axis to horizontally restrain the cutting units between the first and second retaining bars.

14. The cutting die as claimed in claim 1, wherein the horizontal cutting unit retaining elements include at least one retaining bar adjustably mounted for movement along a first axis to horizontally restrain the cutting units between the retaining bar and another surface.

15. The cutting die as claimed in claim 14, further comprising rotatable tightening elements for adjusting the horizontal position of the retaining bar with respect to said primary substrate.

16. The cutting die as claimed in claim 1, wherein said horizontal element is a secondary substrate.

17. The cutting die as claimed in claim 16, wherein said secondary substrate includes a periphery, said length of rule fixedly mounted to the periphery of the substrate.

18. The cutting die as claimed in claim 17, wherein said secondary substrate is comprised of wood.

19. A cutting die comprising:

a primary substrate, said primary substrate defining a substantially horizontal plane;

a plurality of cutting units; each said cutting unit mounted to said primary substrate and including a secondary substrate having a periphery, and a length of rule fixedly attached to the periphery of the secondary substrate, said length of rule including an edge having a cutting surface distally disposed from its respective secondary substrate;

cutting unit retaining elements, said cutting unit retaining elements maintaining the position of the secondary substrates with respect to the primary substrate and restricting movement between said cutting units and said primary substrate; and at least one resilient compressible member disposed between the steel rule of adjacent cutting units, said resilient compressible member being in a laterally-compressed condition between the adjacent cutting units.

20. The cutting die of claim 19, wherein said cutting unit retaining elements include vertical cutting unit retaining elements and horizontal cutting unit retaining elements, said vertical cutting unit retaining elements preventing said cutting units from moving with respect to the primary substrate in a direction perpendicular to said plane, said horizontal cutting unit retaining elements clamping said cutting units horizontally therebetween and preventing said cutting units from moving horizontally with respect to the primary substrate.

21. The cutting die as claimed in claim 20, wherein said vertical cutting unit retaining elements are attached to said primary substrate and each includes a shaft member extending generally perpendicular to said plane and an enlarged end section distal from said primary substrate, each said secondary substrate having a hole therein corresponding to a respective vertical cutting unit retaining element, each said hole having a first portion larger than said enlarged end section and a second portion smaller than said enlarged end section.

22. The cutting die as claimed in claim 20, wherein said horizontal cutting unit retaining elements include first, second, third, and fourth retaining bars, said first and second retaining bars fixedly mounted to said primary substrate and third and fourth retaining bars adjustably mounted to said primary substrate; wherein said third retaining bar is adjustably mounted for movement along a first axis and said fourth retaining bar is adjustably mounted for movement along a second axis, perpendicular to said first axis, said first and second axes being in a horizontal plane.

23. The cutting die of claim 19, wherein each said secondary substrate includes a planar wooden board.

24. The cutting die of claim 23, further comprising holes in each said planar wooden board, wherein at least a portion of the cutting unit retaining elements extend through the holes in the planar wooden boards.

25. The cutting die as claimed in claim 19, wherein for each cutting unit, said length of rule defines a cavity by forming the periphery thereof said cavity having an inside within its length of rule and an outside beyond its length of rule, said length of rule having an inner side disposed adjacent the inside of said cavity, an outer side disposed adjacent the outside of said cavity, and a geometric center substantially bisecting the length of rule, wherein said cutting edge is disposed outwardly from the geometric center of said length of rule with respect to said cavity.

26. The cutting die as claimed in claim 19, further comprising spacer elements disposed between and contacting the length of rule from a pair of adjacent cutting units.

27. The cutting die of claim 10, further comprising at least one resilient compressible member disposed between adjacent cutting units, said resilient compressible member being in a laterally-compressed condition between the adjacent cutting units.

28. A cutting die comprising:

a primary substrate, said primary substrate defining a substantially horizontal plane;

a plurality of cutting units; each said cutting unit mounted to said primary substrate and including a length of rule defining a cavity by forming the periphery thereof a horizontal element extending across the cavity, said length of rule mounted to the horizontal element, said length of rule including a cutting edge distally disposed from its respective horizontal element;

vertical cutting unit retaining elements, each said vertical cutting unit retaining element extending from the primary substrate and through a horizontal element on a cutting unit, said vertical cutting unit retaining elements preventing said cutting units from moving with respect to the primary substrate in a direction perpendicular to said horizontal plane and permitting said cutting units to move with respect to the primary substrate in a direction parallel to said horizontal plane; and at least one horizontally-movable horizontal cutting unit retaining element, said horizontally-movable horizontal cutting unit retaining element cooperating with said cutting units and preventing said cutting units from moving horizontally with respect to the primary substrate.

29. A cutting die comprising:

a primary substrate, said primary substrate defining a substantially horizontal plane;

a plurality of cutting units; each said cutting unit mounted to said primary substrate and including a length of rule defining a cavity by forming the periphery thereof, a horizontal element extending across the cavity, said length of rule mounted to the horizontal element, said length of rule including a cutting edge distally disposed from its respective horizontal element;

vertical cutting unit retaining elements, said vertical cutting unit retaining elements preventing said cutting units from moving with respect to the primary substrate in a direction perpendicular to said plane;

horizontal cutting unit retaining elements, said horizontal cutting unit retaining elements securing said cutting units horizontally therebetween and preventing said cutting units from moving horizontally with respect to the primary substrate; and at least one resilient compressible member disposed between a pair of adjacent cutting units, said resilient compressible member being in a laterally-compressed condition between the adjacent cutting units.

30. A cutting die comprising:

a primary substrate, said primary substrate defining a substantially horizontal plane;

a plurality of cutting units; each said cutting unit mounted to said primary substrate and including a length of rule defining a cavity by forming the periphery thereof, a horizontal element extending across the cavity, said length of rule mounted to the horizontal element, said length of rule including a cutting edge distally disposed from its respective horizontal element, and wherein for each cutting unit, said cavity having an inside within its length of rule and an outside beyond its length of rule, said length of rule having an inner side disposed adjacent the inside of said cavity, an outer side disposed adjacent the outside of said cavity, and a geometric center substantially bisecting the length of rule, wherein said cutting edge is disposed outwardly from the geometric center of said length of rule with respect to said cavity;

vertical cutting unit retaining elements, said vertical cutting unit retaining elements preventing said cutting units from moving with respect to the primary substrate in a direction perpendicular to said plane; and horizontal cutting unit retaining elements, said horizontal cutting unit retaining elements securing said cutting units horizontally therebetween and preventing said cutting units from moving horizontally with respect to the primary substrate.

31. The cutting die of claim 28, wherein said vertical cutting unit retaining elements include a shaft member extending generally perpendicular to said plane and an enlarged end section distal from said primary substrate, each said horizontal element having a tear-drop-shaped hole therein corresponding to a respective vertical cutting retaining element, each said hole having a first portion larger than said enlarged end section enabling relative vertical movement between its respective cutting unit and the primary substrate and a second portion smaller than said enlarged end section preventing vertical separation between its respective cutting unit and the primary substrate.

32. The cutting die of claim 29, wherein said vertical cutting unit retaining elements include a shaft member extending generally perpendicular to said plane and an enlarged end section distal from said primary substrate, each said horizontal element having a tear-drop-shaped hole therein corresponding to a respective vertical cutting retaining element, each said hole having a first portion larger than said enlarged end section enabling relative vertical movement between its respective cutting unit and the primary substrate and a second portion smaller than said enlarged end section preventing vertical separation between its respective cutting unit and the primary substrate.

* * * * *

UNITED STATES PATENT AND TRADEMARK OFFICE

CERTIFICATE OF CORRECTION

PATENT NO. : 5,983,766
DATED : November 16, 1999
INVENTOR(S) : Michael J. Johnson It is certified that error appears in the above-identified patent and that said Letters Patent is hereby corrected as shown below:

Title page,
Section [54], "AND METHOD FOR USING SAME" has been deleted

In the Specification,
Column 4,
Line 45, "15" has been replaced by -- 14 --;
Line 47, "15" has been replaced by -- 14 --;
Line 49, "14" has been replaced by -- 15 --.

Claim 1, column 9,
Line 58, the period has been replaced by a semicolon; and
Line 59, the following has been inserted -- vertical cutting unit retaining elements, said vertical cutting unit retaining elements preventing said cutting units from moving with respect to the primary substrate in a direction perpendicular to said plane; and horizontal cutting unit retaining elements, said horizontal cutting unit retaining elements securing said cutting units horizontally there between and preventing said cutting units from moving horizontally with respect to the primary substrate. --.

Claim 4, column 10,
Line 9, after "respective", -- vertical cutting unit -- has been inserted.

Claim 6, column 10,
Line 22, after "wherein", -- the -- has been inserted.

Claim 9, column 10,
Line 42, after "one", -- resilient -- has been inserted;
Line 42, after "between", -- a pair of -- has been inserted;
Line 43, the period after "units", has been replaced by -- , said resilient compressible member being in a laterally - compressed condition between the adjacent cutting units. --;

UNITED STATES PATENT AND TRADEMARK OFFICE

CERTIFICATE OF CORRECTION

PATENT NO. : 5,983,766
DATED : November 16, 1999
INVENTOR(S) : Michael J. Johnson It is certified that error appears in the above-identified patent and that said Letters Patent is hereby corrected as shown below:

Claim 10, column 10,
Line 54, after "substrate", -- having a periphery -- has been inserted; and after "rule", -- disposed on its periphery -- has been inserted.

Claim 11, column 10,
Line 66, after "one", -- resilient -- has been inserted; and
Line 67, after "units", -- , said resilient compressible member being in a laterally-compressed condition between the adjacent cutting units -- has been inserted.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*